United States Patent [19]

Swanson

[11] Patent Number: 4,630,832

[45] Date of Patent: Dec. 23, 1986

[54] PROJECTILE SENSING TARGET

[76] Inventor: Dale A. Swanson, 6106 Birch Rd., Prior Lake, Minn. 55372

[21] Appl. No.: 640,924

[22] Filed: Aug. 14, 1984

[51] Int. Cl.[4] ..... F41J 5/04

[52] U.S. Cl. ..... 273/374; 273/181 R; 273/381

[58] Field of Search ..... 273/181 R, 181 G, 54 R, 273/371–374, 378, 348, 391, 392, 386, 381

[56] References Cited

U.S. PATENT DOCUMENTS

| | | | |
|---|---|---|---|
| 2,148,438 | 2/1939 | Crain et al. | 273/378 |
| 2,926,916 | 3/1960 | Pearson | 273/374 |
| 3,004,763 | 10/1961 | Knapp | 273/373 |
| 3,091,457 | 5/1963 | Mentzer et al. | 273/54 R |
| 3,370,852 | 2/1968 | Kandel | 273/378 |
| 3,586,331 | 6/1971 | Tickell | 273/372 |
| 4,344,621 | 8/1982 | Baker | 273/378 |
| 4,375,888 | 3/1983 | Willcox | 273/184 R |

*Primary Examiner*—Richard C. Pinkham
*Assistant Examiner*—MaryAnn Stoll Lastova
*Attorney, Agent, or Firm*—Merchant, Gould, Smith, Edell, Welter & Schmidt

[57] ABSTRACT

An apparatus is disclosed for sensing the impact of a projectile. The apparatus includes a target which is a bladder having a predetermined normal volume which is reduced in size upon impact by a projectile. The bladder has an outlet in communication with atmospheric air for providing an escape for a pulse of fluid from the bladder when the bladder volume is reduced in response to impact by a projectile. Resilient foam is disposed within the bladder urging it toward its normal volume after impact by a projectile. A sensor is connected to the bladder for sensing a pulse of air escaping from the bladder.

21 Claims, 7 Drawing Figures

FIG. 1
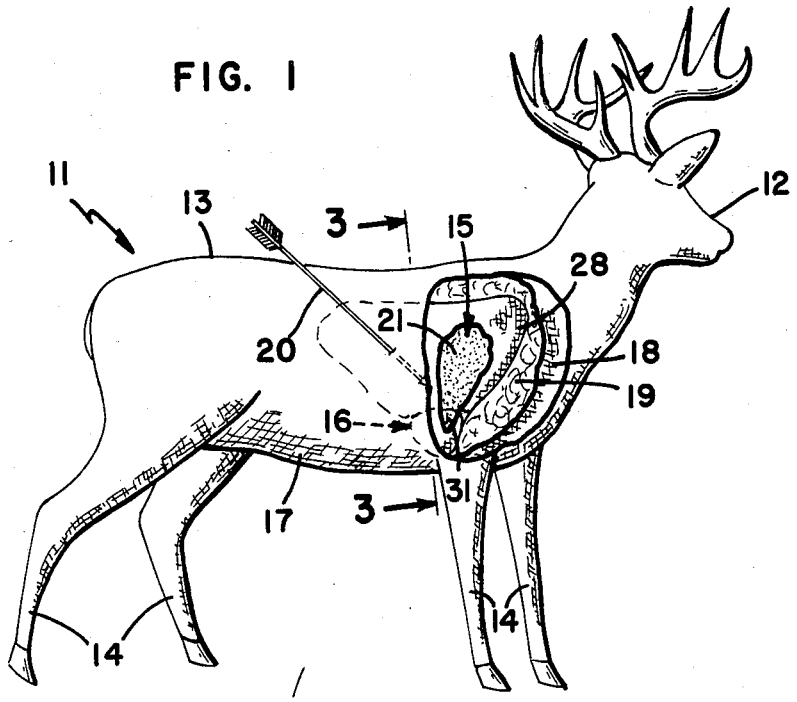
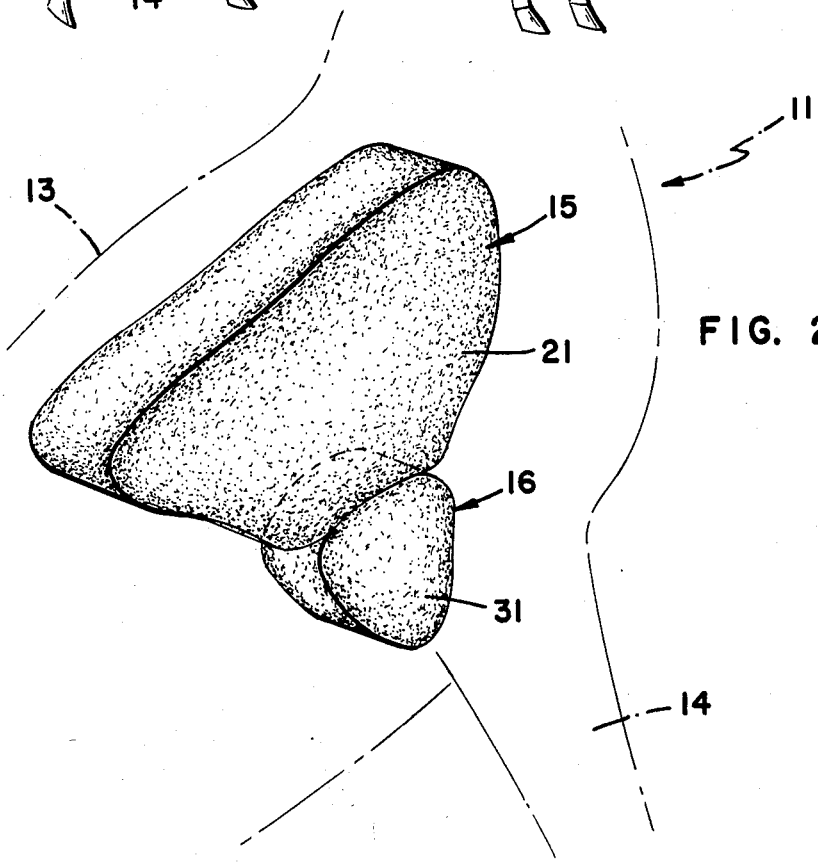
FIG. 2

PROJECTILE SENSING TARGET

The invention broadly relates to target apparatus, and is specifically directed to an automatic scoring target system for bow shooting.

Automatic scoring apparatus for use with targets are known in the prior art. For example, U.S. Pat. No. 3,729,197, which issued on Apr. 24, 1973 to Dale A. Swanson and Wilmer B. Blackaby discloses a system utilizing a plurality of inflatable pressure bags each of which is configured to correspond to a specific target area. These pressure bags define a sealed, variable volume pressure chamber, and the impact of an arrow momentarily decreases the volume of one of the pressure bags to generate a pressure pulse. The pressure pulse is transduced to an electronic signal which is used to actuate a desired type of readout means.

The target apparatus of U.S. Pat. No. 3,729,197 operates quite successfully, but there are a number of problems attendant with the inflatable pressure bags which make the device more difficult to use. For example, since the pressure bags of the afore-mentioned patent define sealed chambers, a problem arises if a bag is punctured, or simply if it leaks pressurized air over a period of time. Maintaining the various pressure bags to operate consistently and uniformly requires some degree of repair and maintenance.

Second, if pressure is lost from a pressure bag, it may be rendered inoperable, in which case it will not generate any pressure pulse, or a pulse that is too weak to activate the control circuit components.

Third, the inflatable pressure bags must be pressurized periodically to insure proper and uniform operation. This not only takes time, but obviously also requires the presence of a pressurized source which must generally be portable.

Last, unless the inflatable pressure bags are maintained at the same operational pressure, which is difficult to accomplish or at least time consuming, the inflatable pressure bag concept is difficult if not impossible to use in conjunction with an analog readout. Analog readouts for target apparatus are desirable where the magnitude of the strike is as important as its location.

The subject invention is the result of an endeavor to create a target scoring apparatus capable of operating at atmospheric pressure without the need for sealed bags operating at greater than atmospheric pressure.

The inventive system comprises a bladder having a flexible outer wall defining an internal chamber the volume of which can be decreased. In the preferred embodiment, the bladder wall is formed from neoprene rubber. If it is used in conjunction with projectiles that can perforate or puncture the bladder itself, the bladder is disposed within a bag of material capable of preventing penetration, such as ballistic nylon or woven polyester.

Resilient means are disposed within the chamber to restore the bladder to its normal configuration after its volume has been momentarily decreased. In the preferred embodiment, resilient foam is disposed within the chamber, having a sponge-like effect to normally maintain the bladder in a predetermined configuration.

The bladder has an air outlet which is connected to a pressure sensor capable of sensing a pulse of air at relatively low pressure and transducing the pressure pulse into an electronic signal used to actuate an indicator light. The specific sensor used is a pneumatic reed switch, having a semirigid flexible strip mounted in cantilever fashion over an air inlet. The reed is moved by the pulse of air to trip a photocell, producing an electronic output signal.

The pneumatic circuit defined by the bladder, sensor and connecting conduit is an open pneumatic system (i.e., open to ambient pressure), thus enabling the bladder to "breath" under the influence of the resilient foam after it has been impacted by a projectile. In the preferred embodiment, the reed switch itself defines air passage means constructed to admit air into the system whatever the operating condition. Thus, when the resilient foam urges the bladder back to its normal configuration, ambient air is drawn into the pneumatic system to assist in restoring the bladder to its normal configuration.

The electronic signal generated by the photocell is used to activate an indicating readout. Since the reed switch itself operates in a digital manner, the readout is likewise digital, and specifically comprises an indicator light in the preferred embodiment.

However, due to the nature of the resilient bladder, it is also possible to use it with an analog pressure transducer which generates a pressure pulse proportional to the magnitude of the force by which it is impacted. This proportional signal can be utilized in an analog control circuit to produce an analog readout, thus enabling the system user to determine the magnitude of the force generated by the projectile.

The target apparatus of the preferred embodiment is a three-dimensional deer in which the targets are the deer's heart and lungs. However, the inventive system is easily applied to any type of target apparatus in which a projectile is intended to strike a target area.

BRIEF DESCRIPTION OF THE DRAWINGS

FIG. 1 is a perspective view of target apparatus taking the form of a deer, portions thereof being broken away and shown in section;

FIG. 2 is an enlarged fragmentary view showing in particular projectile sensing devices which take the form of the deer's heart and lungs;

DESCRIPTION OF THE PREFERRED EMBODIMENT

Figure 3:
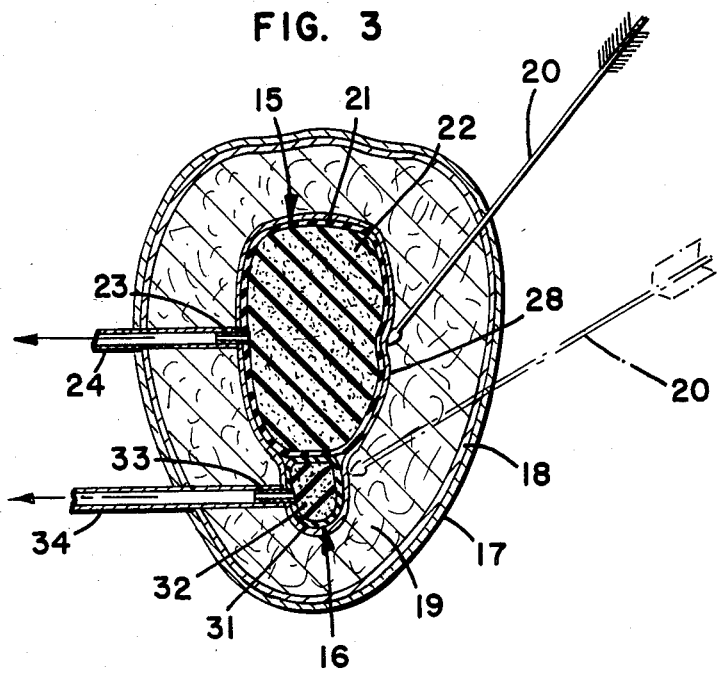
FIG. 3 is an enlarged fragmentary sectional view of the target apparatus taken along the line 3—3 of FIG. 1.

With initial reference to FIGS. 1–3, a target apparatus embodying the invention is represented generally by the numeral 11. In the preferred embodiment, target 11 takes the form of a life-size deer, including a head 12, body 13 and legs 14. Disposed within the body 13 are the lungs 15 and heart 16 of the deer, both of which are projectile sensing devices.

The body 13 of deer target 11 is three dimensional and life-size, being formed with a compound outer layer consisting of a burlap outer skin 17 and an inner liner 18 of poly-weave material (see also FIG. 3). The inner liner 18 withstands continued penetration by arrows 20 without deteriorating. The inner body within the compound outer layer is stuffed with cotton 19.

The backside of the body 13 is provided with a flap (not shown) providing access to an internal pocket or recess within which the simulated lungs 15 and heart 16 are removably disposed. With reference to FIG. 3, this recess is defined by a bag 28 of material which is flexible but impenetrable by the arrows 20. Ballistic nylon or woven polyester are materials which suitably perform these functions.

With specific reference to FIG. 3, the simulated lungs 15 and heart 16 are of virtually identical construction, although the lungs 15 are much larger in size. The projectile sensing lungs 15 comprise an outer layer 21 of material that is flexible and to some extent resilient, while at the same time capable of holding air at ambient pressure and higher without leakage. In the preferred embodiment, the layer 21 comprises neoprene rubber which is formed as closely as possible to the actual configuration of the lungs of a deer thus, defining a bladder. Other materials for the bladder 21 are possible, as long as the configuration of the organ is generally simulated and the outer layer is flexible to sense impact of the arrow or other projectile.

As constructed, the bladder 21 defines a hollow member having an enclosed chamber. Disposed within the chamber is material which causes the layer 21 to have resilience, urging it back to its normal shape after impact by the projectile. In the preferred embodiment, the chamber is filled with porous, air-permeable resilient foam 22, which may be rubber, synthetic or any other suitable material. In the preferred embodiment, the resilient foam 22 fills the entirety of the chamber and is in continuous contact with the entire inner surface of the layer 21. As such, when the layer 21 is struck by a projectile such as the arrow 20, it collapses momentarily in the area of contact, and resumes its normal shape upon removal of the projectile under the influence of the resilient foam 22.

The lung bladder 21 has a small air outlet to which an outlet tube 23 is connected. A fluid conduit 24 has one end connected to the outlet tube 23 with the other end connected to a sensor as described below.

The simulated heart 16 is of substantially the same construction as the simulated lungs 15, although smaller in size and somewhat different in configuration (see FIG. 2). It includes an outer layer 31 of flexible material defining a bladder of the desired configuration, and filled with resilient foam 32. An outlet tube 33 is connected to an air outlet in the bladder 31, and one end of a fluid conduit 34 is connected thereto.

When either of the bladders 21, 31 is impacted by an arrow (as shown in FIG. 3), there is a momentary decrease in volume which produces a pulse of air under pressure at the associated inlets 23, 33. This pulse of air is sensed by a pressure sensor and utilized to actuate a readout.

Figure 4:
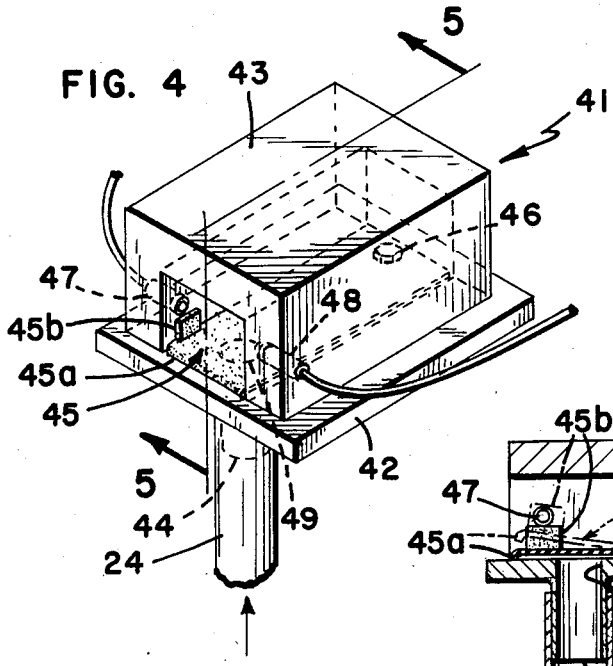
FIG. 4 is an enlarged perspective view of a signal generating device used in connection with the projectile sensing devices.
Figure 5:
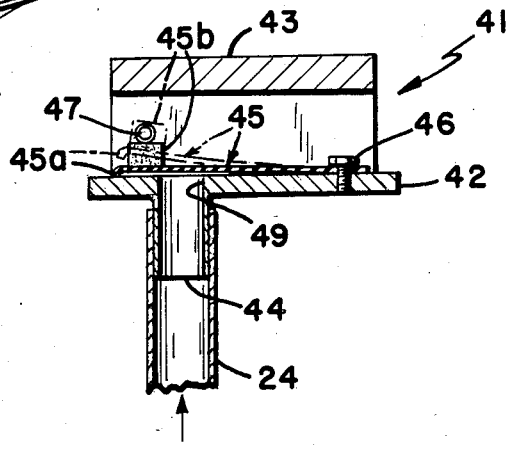
FIG. 5 is a sectional view taken along the line 5—5 of FIG. 4.

With reference to FIGS. 4 and 5, a sensor for the simulated lungs 15 is represented generally by the numeral 41. An identical sensor (not shown) is provided for the simulated heart 16.

Sensor 41 takes the form of a pneumatic reed switch, comprising a base plate 42 which carries a boxlike enclosure 43 having open ends. The base plate 42 has a circular air inlet 49 formed therethrough to which an inlet tube 44 is secured. The opposite end of the fluid conduit 24 from simulated heart 15 is connected to the inlet tube 44.

A strip 45 of semirigid, resilient material has one end secured to the base plate 42 by a screw 46, with the opposite end disposed in overlying relation to the air inlet 49. In the preferred embodiment, the strip 45 is formed from Mylar.

The Mylar strip 45 is constructed and arranged to function as a resilient reed or flap, sensing a pulse of air transmitted through the conduit 24 to momentarily raise, and thereafter return to its normal position overlying the air inlet 43.

In addition, Mylar strip is formed with a lip **45*a* along its front edge, which prevents the strip from completely sealing the inlet 49. As such, a small passage exists between the strip 45 and inlet 49. This passage does not prevent the strip 45 from sensing a pulse of air, but it does enable air to pass into the inlet 49 when the strip 45** is in its normal position.

With continued reference to FIGS. 4 and 5, a light-emitting diode 47 is mounted on one side of the enclosure 42, and a photocell 48 is mounted in opposed relation to the opposite side. The light-emitting diode 47 and photocell 48 are disposed in a position so that the beam of light transmitted therebetween will be traversed by the Mylar strip 45 when it moves upward in response to a pulse of air (FIG. 5). Strip 45 includes a small flag **45*b* that insures continued interruption of the light beam during movement of the strip 45**, avoiding double trippage of the light beam.

The photocell 48 normally conducts when exposed to light, and when the light beam is interrupted by the Mylar strip 45, it momentarily stops conducting. This operation is utilized by a control circuit to actuate a readout device as described below.

Figure 6:
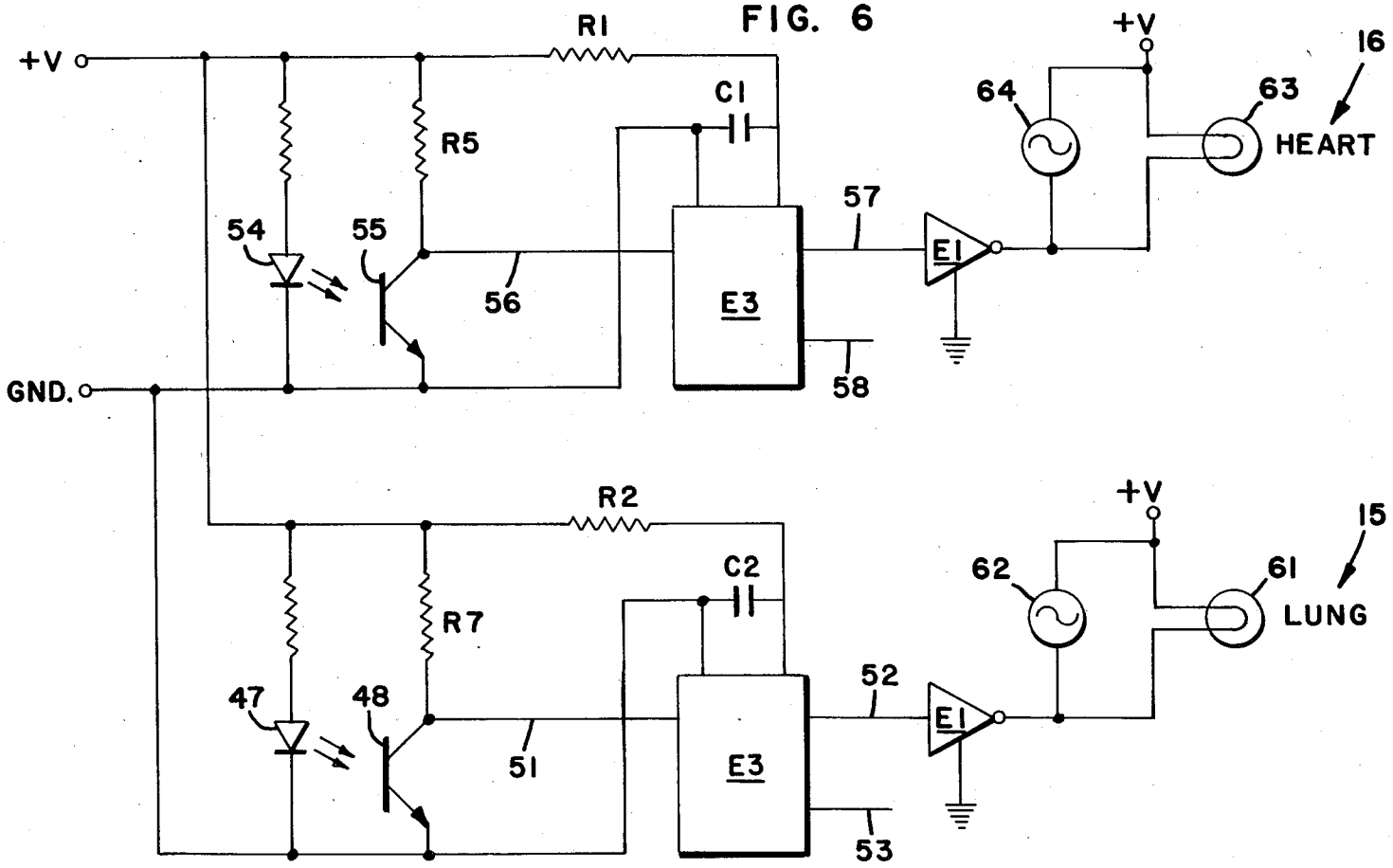
FIG. 6 is a schematic diagram of the control circuit and readout means for the target.

FIG. 6 discloses the control circuit. The light emitting diode 47 and photocell 48 are connected in parallel to a voltage source V. The collector of the photocell 48 is connected to the signal input of a oneshot multivibrator E3 by a conductor 51. The multivibrator E3 is also connected in parallel to the voltage source V through a time delay network consisting of a resistor $R_2$ and a capacitor $C_2$. When the photocell 48 conducts, a circuit is completed to ground, and a null or zero signal exists on conductor 51. This has no effect on the multivibrator E3, and it produces a null or low signal on an output conductor 52. (Multivibrator E3 has an output 53 which is not used.)

When the light beam from light emitting diode 47 is interrupted, photocell 48 stops conducting, and a positive or high signal is generated on conductor 51. This actuates the multivibrator E3, generating a positive or high signal on conductor 52. At the end of a time delay determined by the parameters of the resistor $R_2$ and capacitor $C_2$, multivibrator E3 is restored to its initial state, generating a null or low signal on conductor 52.

Conductor 52 is connected to an inverter E1, the output of which is connected in parallel to a light indicator 61 and a sound generator (siren) 62. These indicator devices are commonly connected to the voltage source V.

Inverter E1 is grounded as shown. As such, when a null or low signal is transmitted by the multivibrator on conductor 52, it acts as an open switch to prevent actuation of the light 61 and siren 62. However, when a positive or high signal exists on conductor 52, inverter E1 acts as a closed switch, completing a circuit from the voltage source V through the light 61 and siren 62 to ground, actuating these indicator devices.

The simulated heart 16 has its own sensor (not shown) identical to the sensor 41 of FIGS. 4 and 5, including a light emitting diode 54 and photocell 55, both of which are also connected in parallel to the voltage source V. The collector of the photocell 55 is connected through a conductor 56 to the input of a multivibrator E3. Multivibrator E3 is also powered by the voltage source V and includes a time delay network consisting of a resistor $R_1$ and capacitor $C_1$.

The output of the "heart" multivibrator E3 is connected to a conductor 57. (An output 58 is not used.)

The conductor 57 is connected to an inverter E1, which in turn is connected through a light 61 and siren 62 to a voltage source V in the same manner as the "lung" portion of the circuit.

In operation, assuming that an arrow 20 strikes the simulated lungs 15, a pressure pulse is generated by impact on the lung bladder 21, which pulse is transmitted through the conduit 24 to lift the Mylar strip 45 and thereby momentarily interrupt the light beam from the light emitting diode 47 as sensed by the photocell 48. Due to the nature of the resilient foam 22, by virtue of the small air passage between strip 45 and inlet 49, creating an open pneumatic circuit, the bladder 21 "breathes" ambient air and becomes restored to its normal configuration and size in a short period of time, ready to be struck again by a projectile.

The momentary interruption in light sensed by the photocell 48 causes the photocell to stop conducting, generating a positive signal on the conductor 51 which actuates the multivibrator E3. This produces a positive signal on the output conduit 52, which immediately operates the inverter to actuate the light 61 and siren 62. After a time delay determined by the $R_2C_2$ network, this portion of the circuit is restored to its normal state, and the light 61 and siren 62 are turned off.

The "heart" portion of the control circuit, which includes the light emitting diode 54 and photocell 55, operates in an identical manner. When the heart bladder 31 is struck by an arrow 20, this results in an interruption of light to the photocell 55, actuating the multivibrator E3 and inverter E1. As a consequence, the light 63 and siren 64 are actuated for a period of time determined by the network $R_1C_1$, after which time the circuit is restored to its normal state.

The pressure sensors (as exemplified by sensor 41) are preferably located at the target apparatus 11, since it is difficult to transmit a low pressure air pulse over a long distance without appreciable loss of magnitude. However, it is possible to transmit the signals generated by the photocells 48, 55 over distances, and the other electric and electronic components of the control circuit of FIG. 6 can be disposed remotely from the target apparatus 11, preferably at a control panel approximate the bow shooter's position.

Figure 7:
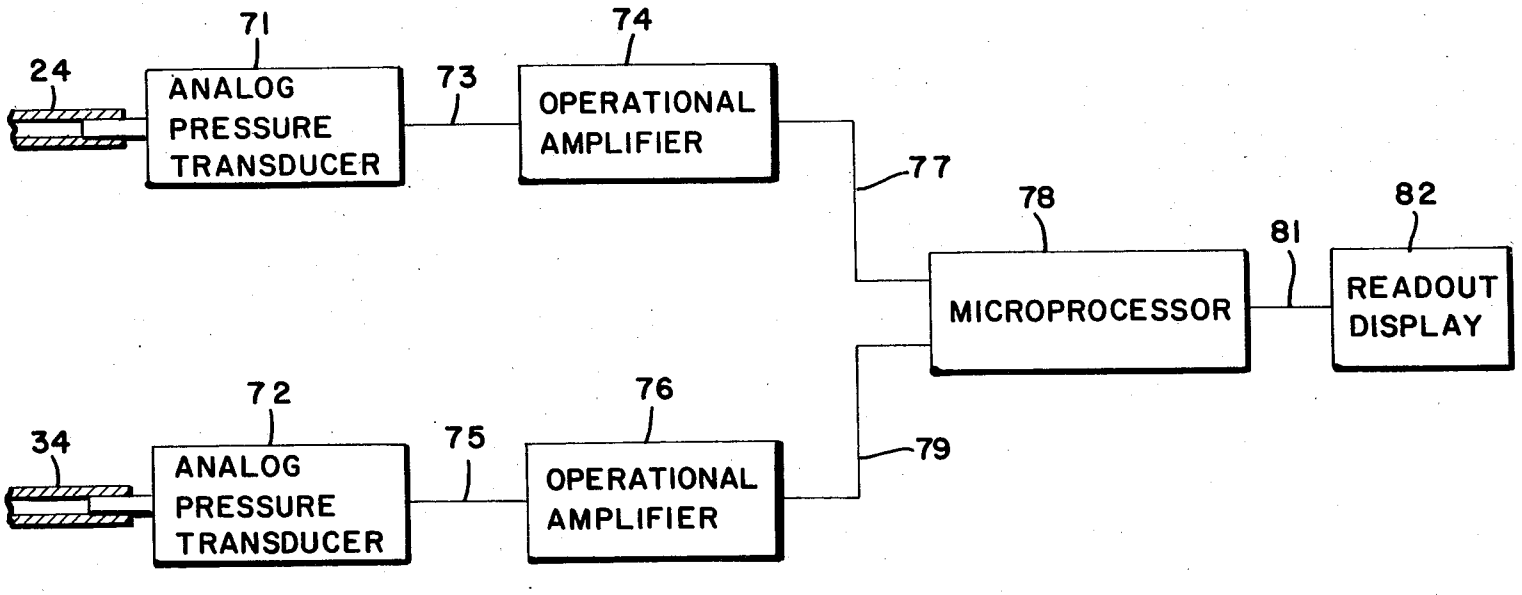
FIG. 7 is a schematic diagram of an alternative control circuit and readout display.

FIG. 7 discloses an alternative control circuit for the target apparatus, in which the magnitude of the pressure pulse is sensed and read out.

Fluid conduit 24, which is connected to the bladder 21 of the simulated lungs, is connected to the inlet of an analog pressure transducer 71, the function of which is to convert the magnitude of the pressure pulse to an analog voltage output. A device capable of performing this function is Model No. 11 Analog Transducer, manufactured by I.C. Sensors Inc., Sunnyvale, Calif.

Fluid conduit 34 is similarly connected to an analog pressure transducer 72 of the same type.

The analog voltage signal generated by transducer 71 is transmitted on a conductor 73 to an operational amplifier 74, which is conventional in nature. A conductor 75 interconnects transducer 72 to a similar operational amplifier 76.

Operational amplifier 74 is connected by a conductor 77 to one input of a microprocessor 78. A conductor 79 interconnects operational amplifier 76 with the same microprocessor 78.

Microprocessor 78 is preferably a Model MC 68705 R3 of Motorola Semiconductor Products Division, Phoenix, Ariz. Microprocessor 78 is capable of receiving the analog signal on conductors 77, 79, converting the signal to digital form, and processing the signal in accordance with a programmable random access memory. The digital output of microprocessor 78 is transmitted by a conductor 81 to a readout display 82, which is conventional in nature. In the preferred embodiment, the readout display includes light emitting diodes. However, the display may alternatively include a liquid crystal display.

In operation, the control circuit of FIG. 7 operates to sense not only which of the simulated lung and heart target areas has been hit, but also how hard it has been impacted by the arrow 20. Preferably, the microprocessor 78 is programmed to generate a digital signal causing the readout display 82 to display an arbitrary number ("points") based on which of the simulated heart and lung target areas have been hit, and how hard the target area has been hit.

The inventive ambient-pressure operated, projectile sensing apparatus is specifically shown in conjunction with target apparatus for bow shooting. However, it will be appreciated that a system using projectile sensing devices of this type could be utilized in any number of different applications.

What is claimed is:

1. Apparatus for sensing the impact of a projectile, comprising:

a target area to be hit by a projectile;

a hollow projectile impenetrable member disposed to be impacted by a projectile which has hit said target area and having an enclosed chamber defined at least in part by a movable wall, the movable wall having a predetermined normal position and being constructed and arranged for movement to permit the chamber to be reduced in size upon impact by a projectile;

the hollow member having an air outlet from which a pulse of air can escape when the size of the chamber is reduced;

resilient means disposed within the chamber and operatively engaging the movable wall for urging the movable wall toward its normal position after impact by a projectile;

sensor means operatively connected to the hollow member for sensing a pulse of air and generating an indicator signal in response thereto indicating a score;

said hollow member and sensor means defining an open pneumatic circuit, said open pneumatic circuit having an air passage in air flow communication with atmospheric air to admit atmospheric air into the open pneumatic circuit as the resilient means urges the movable wall toward its normal position;

said sensor means including means for sensing said pulse of air escaping said circuit.

2. The apparatus defined by claim 1, wherein the movable wall is flexible.

3. The apparatus defined by claim 2, wherein the resilient means comprises a resilient foam.

4. The apparatus defined by claim 2, which further comprises fluid conduit means connecting the fluid outlet to the sensor means.

5. The apparatus defined by claim 4, wherein the sensor means comprises:

a member defining an air inlet, said air inlet being in communication with said enclosed chamber;

a flexible strip of material overlying said air inlet at least in part, and constructed and arranged to be moved by a pulse of air away from said inlet;

and switch means for sensing movement of the strip of material.

6. The apparatus defined by claim 5, wherein the switch means comprises means for generating a beam of light and a photocell disposed in opposition thereto, the strip of material being disposed to traverse said beam of light when moved away from said inlet.

7. The apparatus defined by claim 5, wherein said ambient fluid passage means is defined between said strip and said air inlet.

8. The apparatus defined by claim 2, wherein the fluid passage means is disposed in the sensor means.

9. The apparatus defined by claim 2, wherein the hollow member is defined in substantially its entirety by said flexible wall.

10. The apparatus defined by claim 9, wherein the flexible wall is formed from neoprene rubber.

11. The apparatus defined by claim 2, which further comprises indicator means actuated by said indicator signal.

12. The apparatus defined by claim 11, wherein the indicator means comprises an indicator light and a siren.

13. The apparatus defined by claim 11, wherein the indicator means is constructed and arranged to be restored to an inoperative state after a predetermined time delay.

14. The apparatus defined by claim 2, wherein said indicator means is digitally operated, and said indicator signal is digital.

15. The apparatus defined by claim 2, wherein said sensor means is analog operated, and said indicator signal is analog.

16. Automatic scoring target apparatus comprising:

a target having at least one scoring area for projectiles;

a projectile sensing device associated with said scoring area, including:

a hollow projectile impenetrable member disposed to be impacted by a projectile hitting said scoring area and having an enclosed chamber defined at least in part by a flexible wall, the flexible wall having a predetermined normal position and being constructed and arranged for movement to permit the chamber to be reduced in size upon impact by a projectile;

the hollow member having an air outlet from which a pulse of air can escape when the size of the chamber is reduced;

resilient means disposed within the chamber and operatively engaging the flexible wall for urging the flexible wall toward its normal position after impact by a projectile;

sensor means operatively connected to the hollow member for sensing a pulse of air and generating a readout signal in response thereto;

said hollow member and sensor means defining an open pneumatic circuit, said open pneumatic circuit having an air passage in air flow communication with atmospheric air to admit atmospheric air into the open pneumatic circuit as the resilient means urges the flexible wall toward its normal position;

said sensor means including means for sensing said pulse of air escaping said circuit, and readout means actuated by said readout signal.

17. The apparatus defined by claim 16, wherein:

the target comprises the simulated body of an animal;

and said target apparatus comprises two projectile sensing devices, the hollow members thereof being respectively configured to simulate the heart and lungs of the animal.

18. The apparatus defined by claim 17, wherein the projectiles are arrows, and the simulated animal body comprises:

an outer layer of material defining the animal body and constructed to at least in part resist deterioration from continued impact by arrows;

a stuffing material within the outer layer and constructed to absorb the energy of the arrow;

a recess formed within said stuffing material, the recess being sized and configured to receive the simulated heart and lungs;

and a liner for the recess formed from flexible material that resists penetration by arrows.

19. The apparatus defined by claim 18, wherein the outer layer is compound, comprising an outer skin of burlap and an inner layer of polyweave material.

20. The apparatus defined by claim 18, wherein the liner for said recess is formed from ballistic nylon.

21. Automatic scoring target apparatus comprising:

an outer layer of non-transparent arrow penetrable material shaped to define an animal body and having a chamber disposed within said body;

a projectile sensing device disposed within said chamber in a position approximate to a position of an organ in an animal having a body defined by said outer layer;

said sensing device including a hollow member having a flexible bladder defining a fluid containing chamber having a predetermined normal volume;

said bladder having a fluid outlet from which a pulse of fluid can escape when the volume of the chamber is reduced;

resilient means disposed within said bladder and engaging interior walls of said bladder in force transmitting relation for urging said bladder to said normal volume after impact by a projectile;

sensor means operatively connected to said bladder for sensing a pulse of fluid escaping from said bladder and generating an indicator signal in response thereto;

said bladder and sensor means defining an open fluid circuit having a fluid passage in fluid flow communication with a fluid source exposed to atmospheric pressure to admit fluid from said source into said open fluid circuit as the resilient means urges the bladder toward its normal volume.

* * * * *